US005394985A

United States Patent [19]

Van Hest

[11] Patent Number: 5,394,985

[45] Date of Patent: Mar. 7, 1995

[54] PACKED ELECTRIC LAMP AND BLANK

[75] Inventor: Wilhelmus J. J. Van Hest, Eindhoven, Netherlands

[73] Assignee: U.S. Philips Corporation, New York, N.Y.

[21] Appl. No.: 165,224

[22] Filed: Dec. 10, 1993

[30] Foreign Application Priority Data

Dec. 10, 1992 [EP] European Pat. Off. ..... 92203862

[51] Int. Cl.[6] ..... B65D 85/42

[52] U.S. Cl. ..... 206/418; 206/583

[58] Field of Search ..... 206/418, 419, 583, 592, 206/594

[56] References Cited

U.S. PATENT DOCUMENTS 1,985,075 12/1934 Bird ..... 206/418

3,240,417 3/1966 Andreini ..... 206/418

4,177,918 12/1979 Lane ..... 206/418

4,230,260 10/1980 Kramer ..... 206/418

4,236,662 12/1980 Roccaforte ..... 206/418

4,260,059 4/1981 Roccaforte ..... 206/418

*Primary Examiner*—David T. Fidei

*Attorney, Agent, or Firm*—Ernestine C. Bartlett

[57] ABSTRACT

The electric lamp (4) is packed in an elongate container (1) having an M-shaped elongate insert (2) which comprises a V-shaped seat (21) for the lamp. A removable cover (3) is present over a central portion (25) of the seat (21). A spacer (5) keeps the cover positioned over the seat and separated from a first wall (10) of the container (1), which is opposite to the seat (21). The lamp can easily be packed in and be unpacked from the container. The packaging functions to protect the lamp and is suited to be used for lamps of a variety of shapes.

9 Claims, 4 Drawing Sheets

PACKED ELECTRIC LAMP AND BLANK

FIELD OF THE INVENTION

The invention relates to a packed electric lamp comprising:

an elongate container of plate material which is rectangular in cross-section;

an elongate buffer in the container, formed from plate material about parallel folding lines, which buffer in cross-section is substantially M-shaped so as to have a substantially V-shaped seat for an electric lamp opposite a first wall of the container, which seat is provided with end stops at a first and a second end thereof, while a cover is present over at least a central portion of the seat;

an elongate electric lamp accommodated between the end stops in the seat and clamped between the seat and the cover.

The invention also relates to a blank for making the packed electric lamp.

BACKGROUND OF THE INVENTION

Such a packed electric lamp is known from U.S. Pat. No. 1,985,075.

In the known lamp, the buffer is formed from a strip of material in which parallel incisions are made transverse to the longitudinal direction so as to form a band which, when the buffer is shaped from its blank, will be present as a roof-shaped cover over the seat.

A disadvantage of this buffer is that it is tubular at the area of the cover, so that the lamp to be packed must be brought into position in the seat by sliding. This is disadvantageous, especially when the lamp is comparatively long, while also unpacking of the lamp is inconvenient, especially when the lamp is made of quartz glass and it should be prevented that quartz glass portions which will assume a comparatively high temperature during operation are touched with bare hands. Such constitutes a hazard to the user and is detrimental to the life of the lamp since skin moisture in such places can in fact lead to crystallization of the glass, and thus to explosion of the lamp.

Another disadvantage of the known buffer is that the buffer cannot hold lamps which have a widened portion between end portions. Such a widened portion must lie below the cover where the buffer has been given a window owing to cutting-out of the band forming the cover. The entrance to this portion below the cover is then too narrow in relation to the said widened portion for pushing the lamp into position in the seat.

Packaging is also used for commercially available electric lamps in which a shaped bed of synthetic resin foam is present in the container and a second bed upside-down thereon, between which beds the lamp is accommodated in the cavities present therein. Disadvantages of this packaging are the comparatively high price, the limited recycling possibilities, and also that the container is usually made of a different type of material, for example based on cellulose fibers.

SUMMARY OF THE INVENTION

An object of the invention is to provide a packed electric lamp of the kind described in the opening paragraph comprising a packaging, as well as a blank for this packaging, which is easy to realize, offers a satisfactory protection to the lamp, and is suitable for holding lamps of various shapes.

According to the invention, this object is realized in that the cover is removable, and a spacer is present which keeps the cover positioned over the seat and keeps it separate from the first wall of the container.

The removable cover renders it possible to bring the lamp into the seat by a lateral translation and to take it out by a similar movement. Information may be imprinted on the cover, in the form of text or pictograms, making it clear to the user where the lamp is to be gripped. In the case of lamps having end portions at opposite ends, the contact-sensitive intermediate portion may lie below the cover. The lamp may then be gripped by the end portions and lifted, whereby the cover is pulled from its position. When packed in the container, however, the lamp is kept fixed in the seat by the spacer which keeps the cover in position over the seat and separated from the first wall.

The spacer may be integral with the cover and, for example, be a rectangular or triangular sleeve, or a channel, for example, U-shaped. Preferred however, is an embodiment in which the cover is hinged to the buffer. The cover may then be cut out from the buffer, leaving a window in the seat. The buffer can then accommodate not only tubular lamps, but also lamps having a widened portion, for example, a spherical or egg-shaped portion between the end portions. Such a widened portion may then lie recessed in the window.

The container may be a sleeve, but in an advantageous embodiment it is a box in which the first wall of the container is a lid hinged to an elongate second wall of the container. The packed lamp may then be taken from the seat of the buffer and from the container in one lateral movement.

In a particular embodiment, the spacer is connected to a third wall situated opposite the second wall. The spacer is then integral with the box and accordingly always present, which is a logistic advantage, and can be readily given the correct position in the box.

In a modification thereof, the spacer is connected to said third wall via a connection strip. A convenient spacer in this case is one which forms a channel, for example U-shaped. The legs of this U may press on the cover in chosen locations, for example sideways of the lamp, so as to give the cover a tension over the lamp. An increased friction between the lamp and the cover can be generated thereby, if the lamp should tend to slide in the container under the influence of a shock.

In a special embodiment, the box and the buffer have complementary tear-off points of a tearing line. In this embodiment, the box and the buffer are formed from a single blank in that their blanks connected to one another along a tearing line are separated by tearing and the box and the buffer are shaped from the relevant blanks. This embodiment has a further advantage in that it is logistically simple.

Preferred embodiments of the packed lamp are those in which the packing components are made of plate or sheet material based on cellulose fibers such as, for example, duplex or triplex paperboard, corrugated paperboard, mini- or semicorrugated cardboard. The type and quality of the sheet material may readily be chosen by those skilled in the art in a small test in dependence on the mass and vulnerability of the electric lamp to be packed.

The electric lamp may be, for example, a halogen incandescent lamp which is, for example, tubular or at least partly convex. The lamp may be provided with lamp caps at one end or at two ends. Alternatively, however, the lamp may be a discharge lamp, possibly a high-pressure discharge lamp, with one or two ends, possibly provided with lamp caps.

BRIEF DESCRIPTION OF THE DRAWINGS

Embodiments of the packed electric lamp according to the invention are shown in the drawing, in which.

DETAILED DESCRIPTION OF THE PREFERRED EMBODIMENTS

Figure 1A:
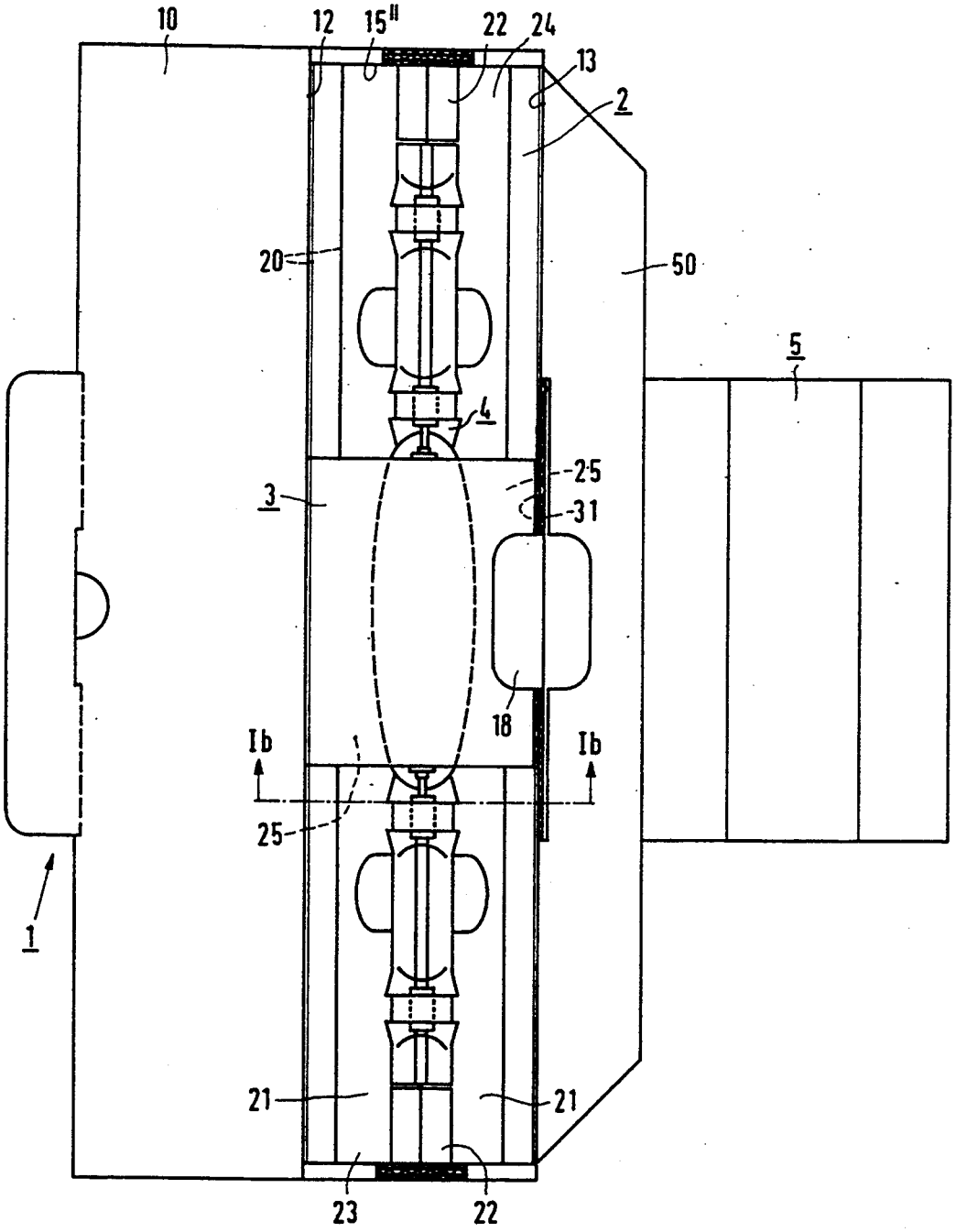
FIG. 1*a* is a plan view of an opened container with an electric lamp inside.
Figure 1B:
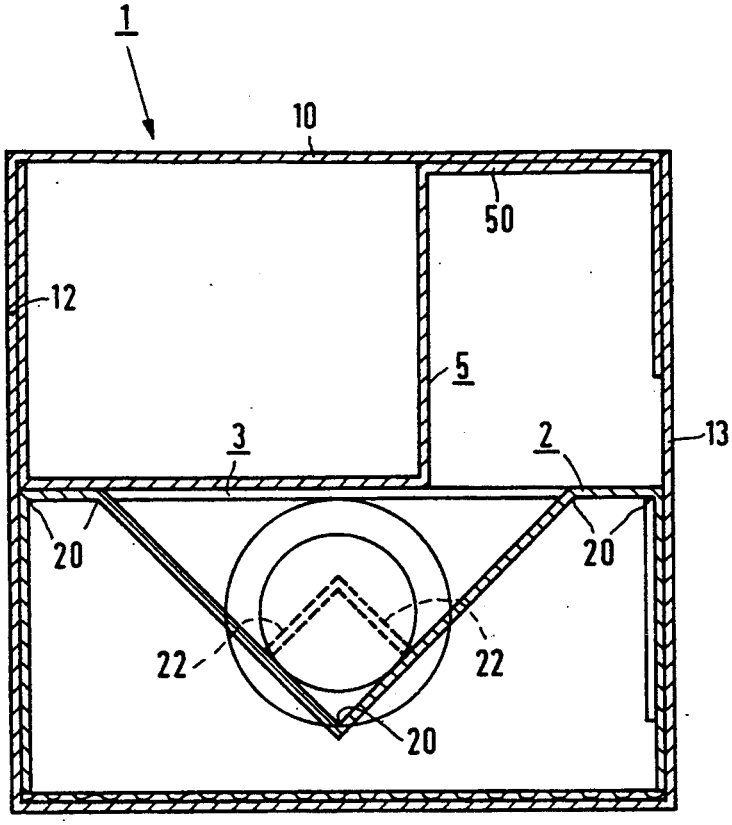
FIG. 1*b* is a cross-section taken on the line Ib of the same container in the closed state.
Figure 1C:
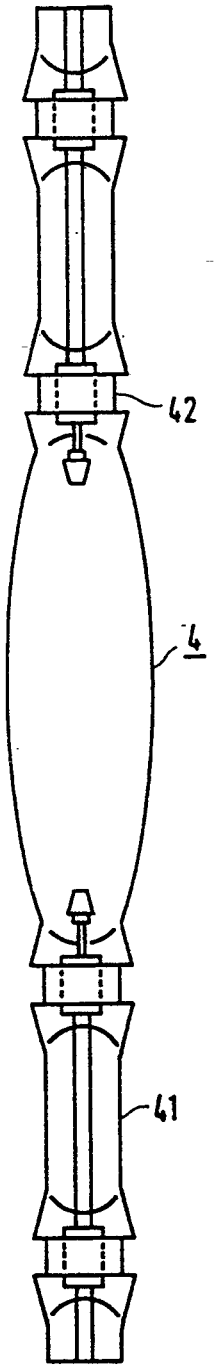
FIG. 1*c* shows the electric lamp from FIGS. 1*a* and *b;*

The packed electric lamp of FIG. 1 has an elongate container 1 of sheet material, which container is rectangular in cross-section. A buffer 2 is present therein, formed from plate material about parallel folding lines 20. The buffer 2 is substantially M-shaped in cross-section so as to provide a substantially V-shaped seat 21 for an electric lamp opposite a first wall 10 of the container 1. The seat is provided with end stops 22 and a first and a second end 23, 24 thereof. The end stops in the embodiment illustrated are bands cut out from the bottom of the V and folded up from the bottom of the V. The end stops, however, may have various alternative shapes such as, for example, a nose folded upwards about folding lines which approach one another obliquely. A cover 3 is present over at least a central portion 25 of the seat. An elongate electric lamp 4 is accommodated between the end stops 22 in the seat 21 and enclosed between the seat and the cover 3.

The cover 3 is removable, and a spacer 5 is present holding the cover in position over the seat 21 and separating it from the first wall 10 of the container 1.

In FIG. 1, the cover 3 is hinged to the buffer 2 by means of a folding line 32.

The container 1 is a box and the first wall 10 of the container is a lid hinged to an elongate second wall 12 of this container.

The box has a third wall 13 opposite the second wall 12, and the spacer 5 is connected to the third wall.

The spacer 5 is U-shaped in cross-section and is connected to the third wall 13 by means of a connection strip 50.

Figure 2:
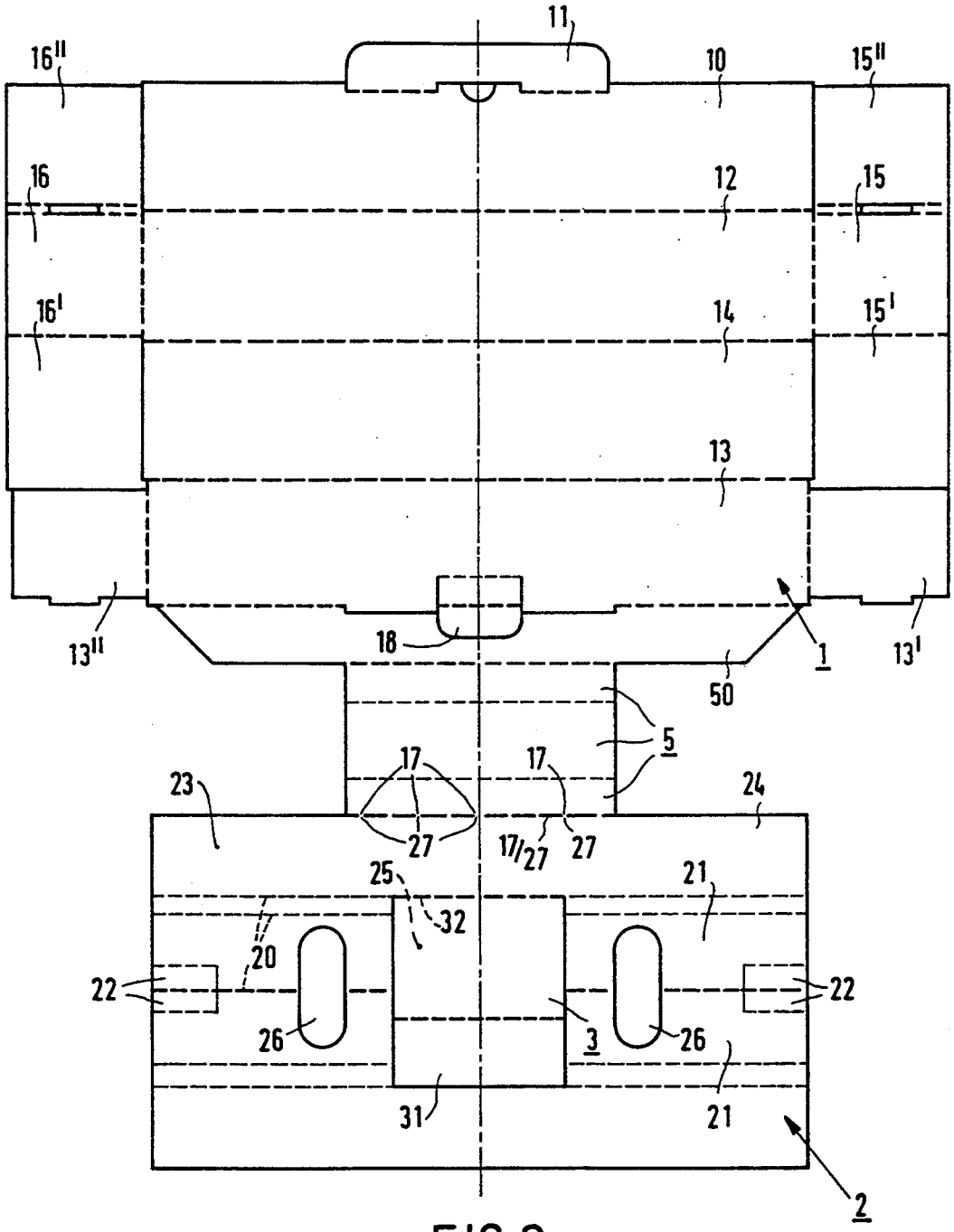
FIG. 2 shows the blank of the container and buffer of FIG. 1.

The container 1 and the buffer 2 have complementary tearing points 17 and 27, respectively, of a tearing line 17/27 (FIG. 2).

The electric lamp 4 shown is a high-pressure discharge lamp with a substantially tubular lamp vessel which has a widened central portion and comparatively long end portions 41, 42.

In FIG. 2, the blank of the container and of the buffer of the packed electric lamp of FIG. 1 has an elongate base wall 14 connected to a second 12 and a third wall 13 along folding lines. The second wall is connected to end walls 15, 16 along folding lines. The end walls are each provided with fixation flaps 15', 15'' and 16', 16'', respectively. The third wall carries end flaps 13', 13''.

For shaping the container from the blank, the fixation flaps 15', 16' are folded up about the folding line with the relevant end walls 15, 16. The second wall is folded up about the folding line with the base wall. The fixation flaps will then lie against the base wall 14.

The end flaps 13', 13'' are folded up and the third wall is also folded up, whereby the end flaps 13', 13'' will bear on the end walls 15, 16 and on the fixation flaps 15', 15'', respectively. The fixation flaps 15'', 16'' are subsequently folded inwards over the end flaps 13', 13'', respectively, into the box thus shaped. The shape of the box is thus fixed without the use of adhesives or connectors. The blank of the buffer 2 may have been tom from the box 1 on the tearing line 17/27, during which complementary tearing points 17, 27 were created.

The buffer 2 may be shaped and put in the box, the fixation flaps 15'' and 16'' being secured against moving upwards in that they are enclosed between the relevant end wall 15, 16 and the buffer 2.

The electric lamp may then be laid in the seat 21 of the buffer 2 by a lateral translation, and the cover 3 may be hinged over the seat 21 and the lamp 4, upon which a tag 31 at the cover may be inserted into the buffer. The tag 31 prevents the cover moving upwards before the spacer is provided.

The spacer 5 is folded into its U-shape about folding lines and swivelled with the connection strip 50 into the box. The first wall 10 is then hinged over the box as a lid about a folding line shared with the elongate second wall 12, and a closing flap 11 is inserted into the box. A fixation flap 18 at the third wall 13 may then be inserted into an incision 18 so as to fix the first wall 10 in its position.

After opening of the container described, the spacer 5 may be lifted. The cover 3 then becomes visible. The seat 21 has holes 26 on either side of the central portion. In these holes, the packed lamp may be gripped with bare hands at portions which remain comparatively cold during operation, so that this is not a disadvantage. The lamp may be lifted, whereby the cover is automatically removed, so that the lamp can be taken from its packaging.

The opening in the central portion 25 of the seat 21 renders it possible to accommodate a tubular electric lamp with a bulbous central portion in the same buffer. The said central portion then lies recessed in the opening of the seat created by cutting-out of the cover 3.

In the embodiment shown, minicorrugated paperboard is used as the plate material.

Figure 3A:
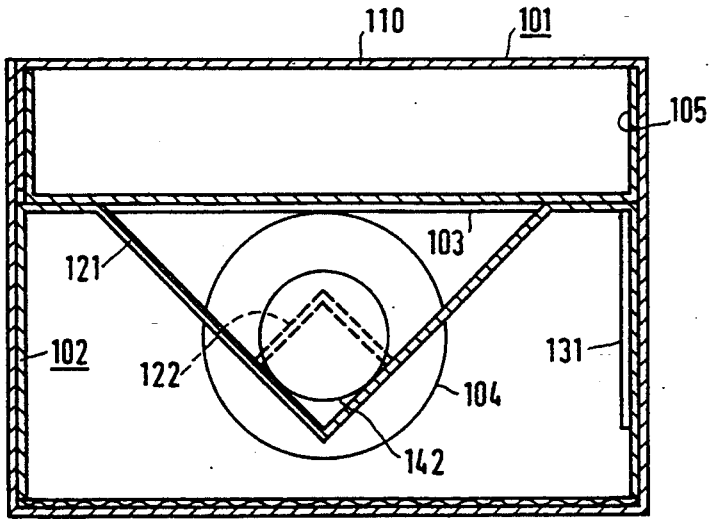
FIG. 3*a* shows a different embodiment from that of FIG. 1*b*.
Figure 3B:
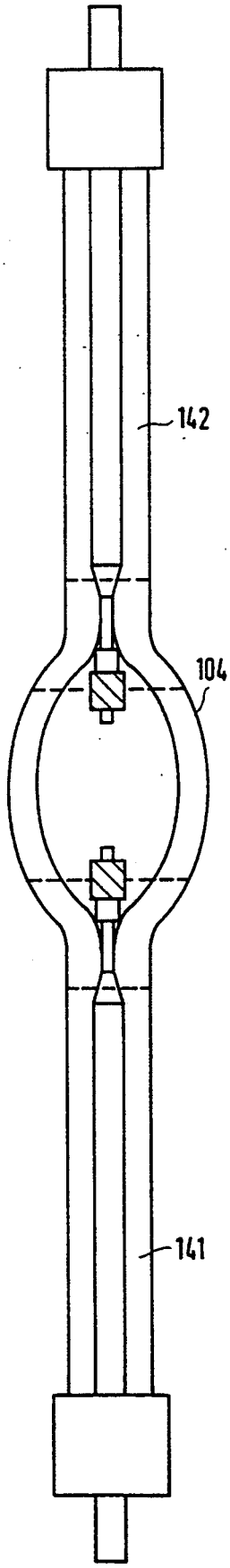
FIG. 3*b* shows the electric lamp of FIG. 3*a*.

In the embodiment of FIG. 3, corresponding parts have reference numerals which are 100 higher than those in the preceding Figures.

The container 101 is a sleeve from which the buffer 102 with the spacer 105 can be pulled out. The lamp 104 has a bulbous central portion and tubular end portions 141,142.

In a modified version, the sleeve shown is a box having closures at its ends.

What is claimed is:

1. A packed electric lamp comprising:

an elongate container (1) of plate material which is rectangular in cross-section;

an elongate buffer (2) in the container, formed from plate material about parallel folding lines (20), which buffer (2) in cross-section is substantially M-shaped so as to have a substantially V-shaped seat (21) for an electric lamp opposite a first wall (10) of the container (1), which substantially V-shaped seat is provided with end stops (22) at a first and a second end (23, 24) thereof, while a cover (3) is present over at least a central portion (25) of the substantially V-shaped seat;

an elongate electric lamp (4) accommodated between the end stops (22) in the substantially V-shaped seat (21) and clamped between the substantially V-shaped seat and the cover (3), characterized in that the cover (3) is removable, and a spacer (5) is present which keeps the cover positioned over the substantially V-shaped seat (21 ) and keeps it separate from the first wall (10) of the container (1).

2. A packed electric lamp as claimed in claim 1, characterized in that the cover (3) is hinged to the buffer (2).

3. A packed electric lamp as claimed in claim 1, characterized in that the container (1) is a box, and the first wall (10) of the container is a cover hinged to an elongate second wall (12) of this container.

4. A packed electric lamp as claimed in claim 3, characterized in that the container has a third wall (13) opposite the second wall (12), and the spacer (5) is connected to the third wall.

5. A packed electric lamp as claimed in claim 3, characterized in that the spacer (5) is U-shaped in cross-section and is connected to the third wall (13) by a connection strip (50).

6. A packed electric lamp as claimed in claim 4, characterized in that the container (1) and the buffer (2) have complementary tearing points (17, 27) of a tearing line (17/27).

7. A blank for the container and for the buffer of the packed electric lamp as claimed in claim 6.

8. A packed electric lamp as claimed in claim 2, wherein the container (1) is a box, and the first wall (10) of the container is a cover hinged to an elongate second wall (12) of this container.

9. A packed electric lamp as claimed in claim 5, wherein the container (1) and the buffer (2) have complementary tearing points (17, 27) of a tearing line (17/27).

* * * * *